US008672255B2

(12) United States Patent
Granger

(10) Patent No.: US 8,672,255 B2
(45) Date of Patent: Mar. 18, 2014

(54) PRE-CUT WIPING MATERIAL DISPENSING APPARATUS

(76) Inventor: Maurice Granger, Saint Priest en Jarez (FR)

( * ) Notice: Subject to any disclaimer, the term of this patent is extended or adjusted under 35 U.S.C. 154(b) by 735 days.

(21) Appl. No.: 12/993,984

(22) PCT Filed: May 13, 2009

(86) PCT No.: PCT/FR2009/050876

§ 371 (c)(1),
(2), (4) Date: Nov. 22, 2010

(87) PCT Pub. No.: WO2009/150342

PCT Pub. Date: Dec. 17, 2009

(65) Prior Publication Data

US 2011/0089213 A1 Apr. 21, 2011

(30) Foreign Application Priority Data

May 21, 2008 (FR) ..... 08 53284

(51) Int. Cl.
*B65H 16/06* (2006.01)

(52) U.S. Cl.
USPC ..... 242/596.8; 242/615.3

(58) Field of Classification Search
USPC ..... 242/566, 615.3, 562.1, 596.8, 598.5
See application file for complete search history.

(56) References Cited

U.S. PATENT DOCUMENTS

| | | | | | |
|---|---|---|---|---|---|
| 1,334,653 | A | * | 3/1920 | Dwyer | 242/594.3 |
| 1,514,399 | A | | 11/1924 | Steiner | |
| 2,169,399 | A | * | 8/1939 | Steiner | 242/596.7 |
| 2,434,194 | A | * | 1/1948 | Broeren et al. | 242/596.8 |
| 2,645,170 | A | * | 7/1953 | Reinhold | 396/442 |
| 2,747,547 | A | * | 5/1956 | Drasher | 226/195 |
| 3,974,947 | A | | 8/1976 | Budny | |
| 4,666,072 | A | * | 5/1987 | McCarter | 225/25 |

OTHER PUBLICATIONS

International Search Report for PCT/FR2009/050876 dated Dec. 1, 2009.

* cited by examiner

*Primary Examiner* — William A Rivera
(74) *Attorney, Agent, or Firm* — Heslin Rotheberg Farley & Mesiti P.C.

(57) ABSTRACT

A wipe material dispensing machine includes a housing forming a receptacle with a back plate, a horizontal lower wall, side walls, and an articulated lockable cover. The inner face of the cover has a protruding curved member. A device, articulated relative to the housing, fulfils the functions of loading, guiding and preventing creasing of the pre-cut strip of material which is pulled so that it can be removed from the forward, lower part of the machine. The device includes a raised curved element surrounding the member on the cover when the cover is closed. The element and member being concentric and leaving room for the pulled pre-cut strip of material to pass through. The pre-cut wipe material is wound on a reel or accordion pleated, and the lower part of the machine includes, at the point where the material emerges, opposite-facing limit stops.

20 Claims, 11 Drawing Sheets

PRE-CUT WIPING MATERIAL DISPENSING APPARATUS

CROSS REFERENCE TO RELATED APPLICATIONS

This application is a national stage filing under section 371 of International Application No. PCT/FR2009/050876 filed on May 13, 2009, published in French on Dec. 17, 2009 as WO 2009/150342 and claims priority of French application No. 0853284 filed on May 21, 2008, the entire disclosure of these applications being hereby incorporated herein by reference.

BACKGROUND ART

The invention relates to the technical field of dispensing machines for wipe materials of the hand wipe, toilet paper, general-purpose wipe and similar types.

The Applicant has worked in this specific field for many years and has filed several dozen patents for machines of this type with automatic or semi-automatic cutting which operate simply by the user pulling the end of the strip of material that emerges from the machine.

The strip of material can be wound on a reel and the machine then has to be designed with an automatic cutting device which makes it possible to cut the strip into pieces of a predetermined size while allowing the end of the strip to emerge from the machine so that it can be pulled and cut to size depending on the wipe material.

In this configuration, the strip of material is uniform and is not pre-cut when it is manufactured and wound.

The Applicant was also interested in designing a machine to dispense wipe material pre-folded in an accordion pleat, but with complex configurations and layouts.

For general-purpose wipe material, the use of a reel with the material pre-cut to pieces of a set size is, moreover, already known. These reels are generally wound on a core which can, if applicable, be mounted on a simplified unwinding device with two end pieces which penetrate into the core and a mounting base.

The approach adopted by the Applicant was to concentrate on designing a simplified machine for dispensing strips or pre-cut wipe material that can be wound on a reel or folded in Z- (or accordion) pleats.

The Applicant aimed to produce a simple, inexpensive dispensing machine which, because of the way in which the pre-cut material, on a reel or accordion pleated, is presented, does not need a cutting system.

The sought-after object was to produce a compact, silent, easy-to-load dispensing machine which can be used with both these types of materials.

BRIEF SUMMARY OF INVENTION

The solution devised by the Applicant fulfils these various objectives.

According to a first aspect, the wipe material dispensing machine of the type comprising a housing forming a receptacle with a back plate, a horizontal lower wall and side walls as well as an articulated cover with means of locking, is distinctive in that the inner face of the cover is designed with a protruding curved shape, and in that it comprises a device which is articulated relative to the housing and fulfils the functions of loading, guiding and preventing creasing of the pre-cut strip of material which is pulled so that it can be removed from the forward, lower part of the machine and in that said device includes curved shapes capable of surrounding the shape on the cover when said cover is closed, said shapes being concentric and allowing the pulled pre-cut strip of material to pass through, and in that the pre-cut wipe material is wound on a reel or accordion pleated, and in that the lower part of the machine comprises, at the point where the material emerges, opposite-facing limit stops either side of the strip of material which ensure separation of a piece of strip relative to the opposite facing perforation line of the strip.

According to another aspect of the invention, the wipe material dispensing machine is distinctive in that the device for loading, guiding and preventing creasing of the pre-cut strip of material comprises a single component which fulfils said functions.

According to another aspect of the invention, the wipe material dispensing machine is distinctive in that the device for loading, guiding and preventing creasing of the pre-cut strip of material comprises a plate for loading and guiding the strip of material and a plate for preventing creasing (anti-crease plate).

BRIEF DESCRIPTION OF DRAWINGS FIGURES

The object of the present invention is described, merely by way of example, in the accompanying drawings in which.

DETAILED DESCRIPTION

Figure 1:
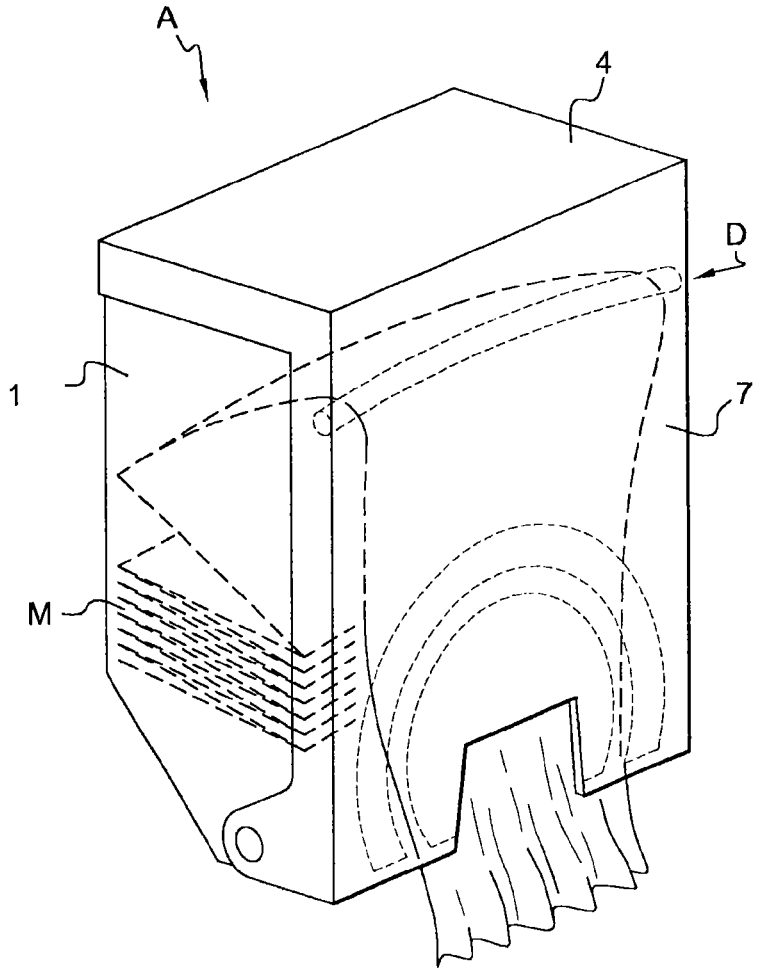
FIG. 1 is a three-quarter perspective view of a first model of the dispensing machine according to the invention when it is closed.

In order that the object of the invention may more readily be understood, the following description is given, merely by way of example, reference being made to the accompanying drawings.

The wipe material dispensing machine is referred to in its entirety as (A) and is used to dispense pre-cut strips of material, wound on a reel or accordion pleated. It comprises a housing (1) having a parallelepiped shape which forms a receptacle with a back plate (1*a*), a lower horizontal wall (1*b*), lateral side walls (1*c*) and an articulated cover (2) with means of locking (3).

According to the invention, the housing and the cover are designed with central cut-out shapes to allow the strip of material pulled by the operative to emerge from the machine. The machine comprises a device (D) for loading, guiding and preventing creasing of the pulled pre-cut strip of material so that it can be removed from the base of the machine. In a first version, this device is designed and produced as a single part which fulfils various functions such as loading, guiding and preventing creasing in cooperation with the cover which is designed with matching shapes, as shown in FIGS. 1 to 4. In a second version, this device (D) is designed with firstly a plate for loading and guiding and secondly an anti-crease plate operating in cooperation with the cover which is designed with matching shapes, as shown in FIGS. 5 to 12.

Each of the versions in the above-mentioned Figures can be used, regardless whether the pre-cut material that is dispensed is wound on a reel or folded. Depending on the nature of the strip of wipe material—wound on a reel or folded—one can, without modifying the concept of the invention, use a housing which accommodates both types of materials or the volume of the housing can be designed depending on the presentation of the pre-cut strip of material (wound on a reel or folded). First of all, the design and implementation of the housing of the machine may have characteristics that are common to all the versions described below.

In the model for dispensing strips of material wound on a reel, the second version is shown but the first version is not shown, the side walls (1*c*) of the housing in the model for dispensing strips of material wound on a reel, each comprise a flexible strut (1*d*) to support end fitting (2) to accommodate and fit into core (3) of reel (B) of wipe material.

In the embodiment of the first version (FIGS. 1 to 4), horizontal back plate (1*e*) receives the stack of pre-cut accordion pleated material to be dispensed or a reel of pre-cut material.

In the embodiment of the second version (FIGS. 5 to 12), the front part of the back plate has a central cut-out (1*f*). Offset towards the rear of said central cut-out (1*f*) there is a separately mounted or moulded transverse wall (1*g*) which delimits the positioning of the reel of material by preventing access to the interior of the receptacle formed by the housing thus designed.

The front part of the latter accommodates a cover (4) articulated on connecting shafts (5) located on the side walls of the housing. The cover thus has a front wall (4*a*) with a cut-out (4*b*) located very precisely opposite the central cut-out (1*f*) formed in the housing which allows the strip of material to pass through and be pulled by the user. The upper wall (1*b*) of the cover is designed with a tab (5) which locks the cover in its closed position. According to one essential feature of the invention, in both versions, the internal part (4*a*1) of the front wall is designed with a protruding shape (6) designed to help guide and prevent creasing of the pulled material in close cooperation with device (D) for loading, guiding and preventing creasing of the strip of material pulled by the operative.

The two implementations of said device (D) shown respectively in FIGS. 1 to 4 and FIGS. 5 to 12 are now described below.

Figure 2B:
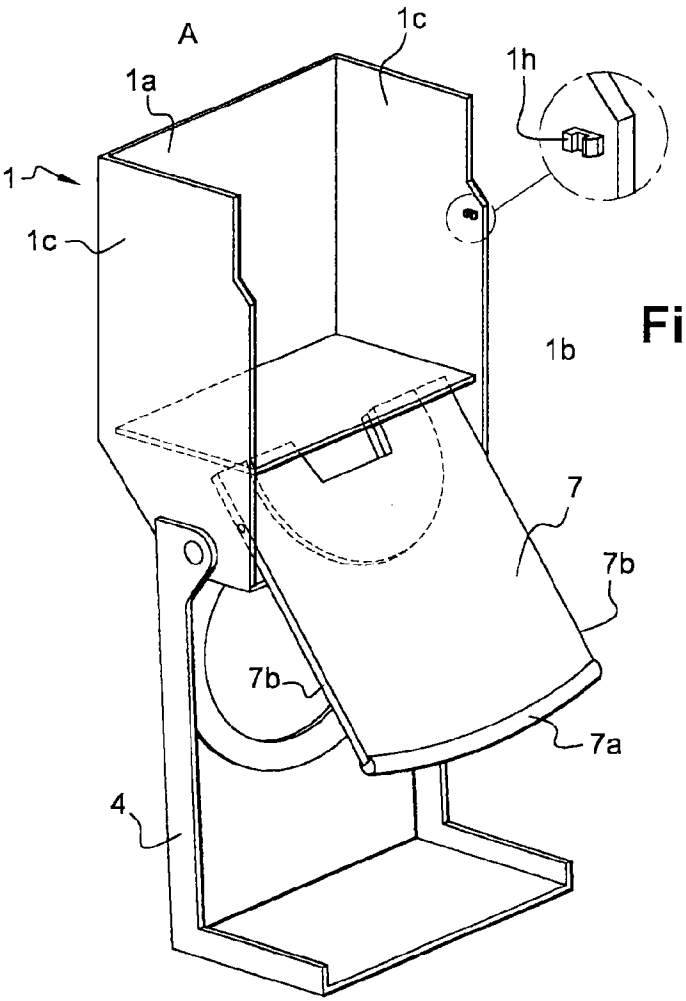
FIGS. 2A and 2B are views as in FIG. 1 of the machine when it is opened with the intermediate flap in its closed position (FIG. 2A) or opened position (FIG. 2B).
Figure 2A:
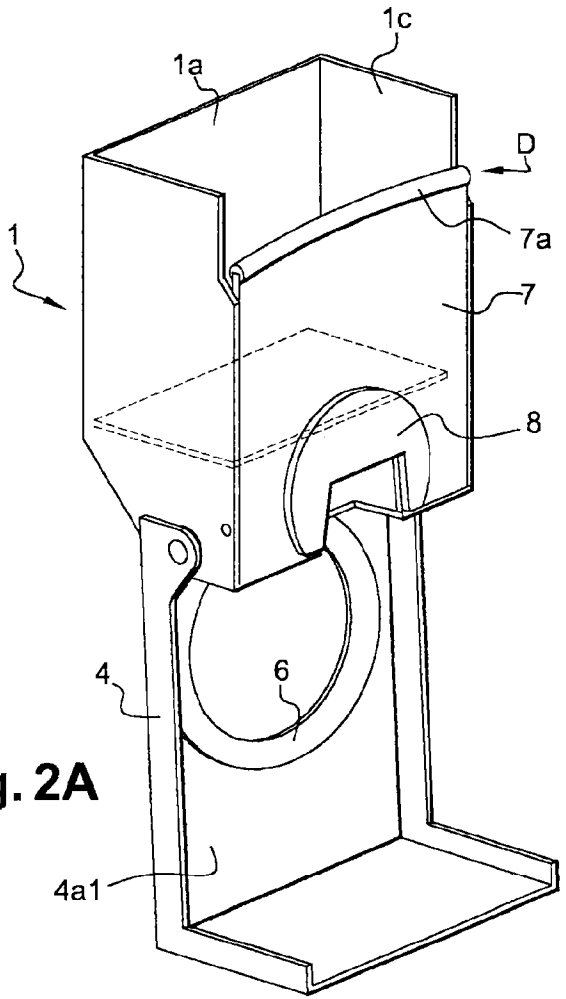
Figure 3A:
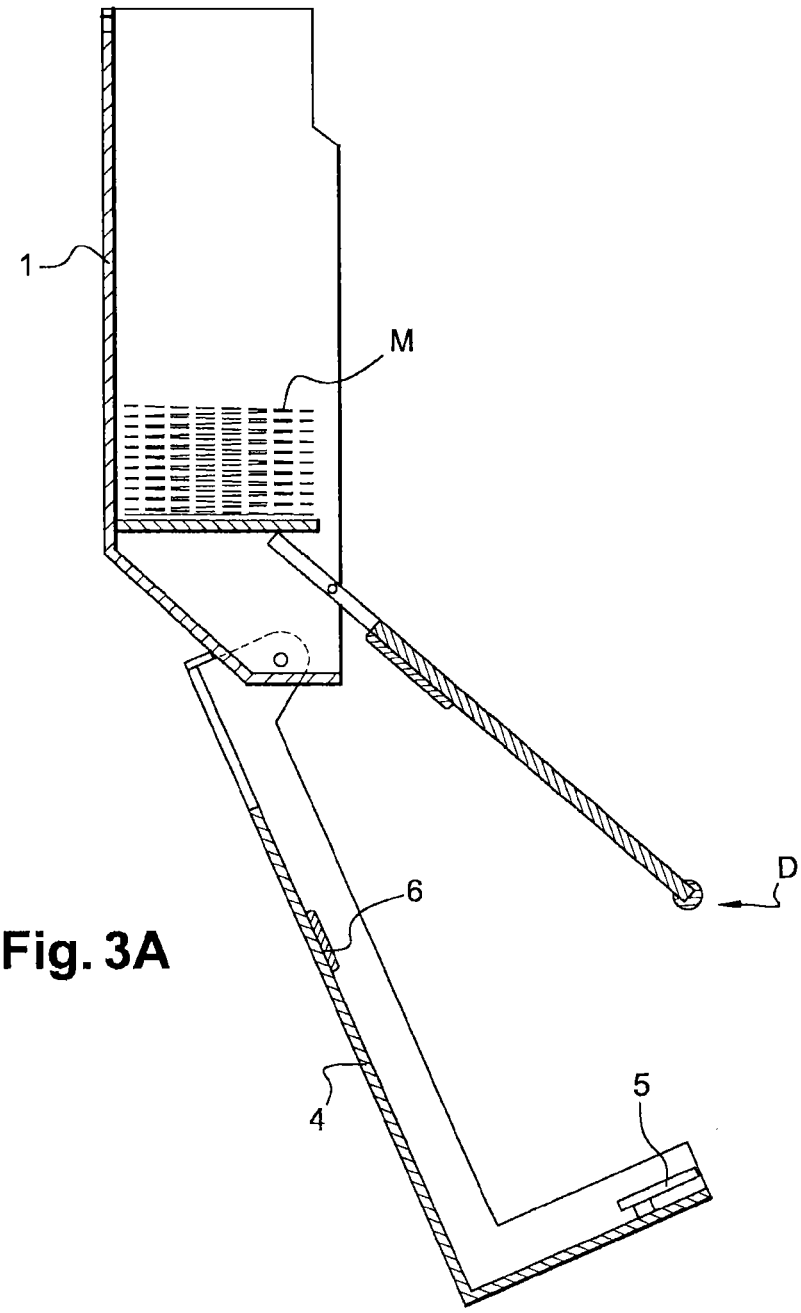
FIG. 3A is a cross-sectional side view of the machine when it is opened as in FIG. 2B.
Figure 3B:
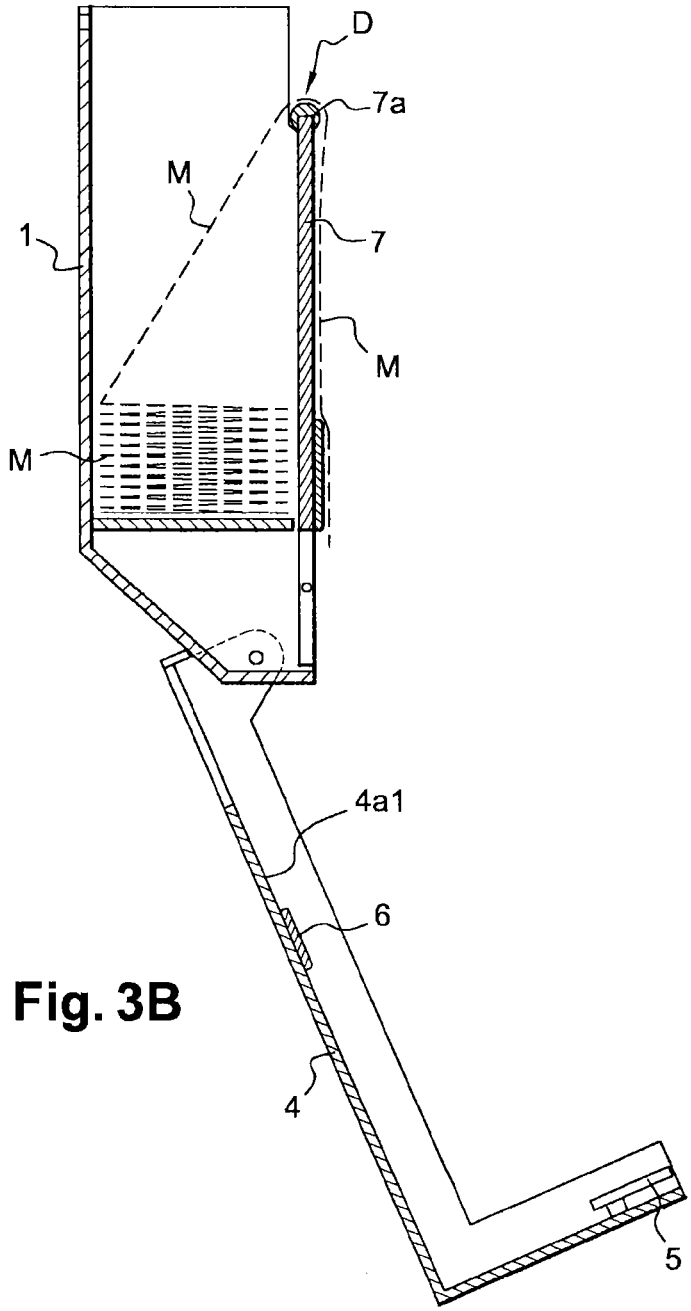
FIG. 3B is a cross-sectional view of the machine as in FIG. 2A when it is opened, showing transport of the strip of material.
Figure 3C:
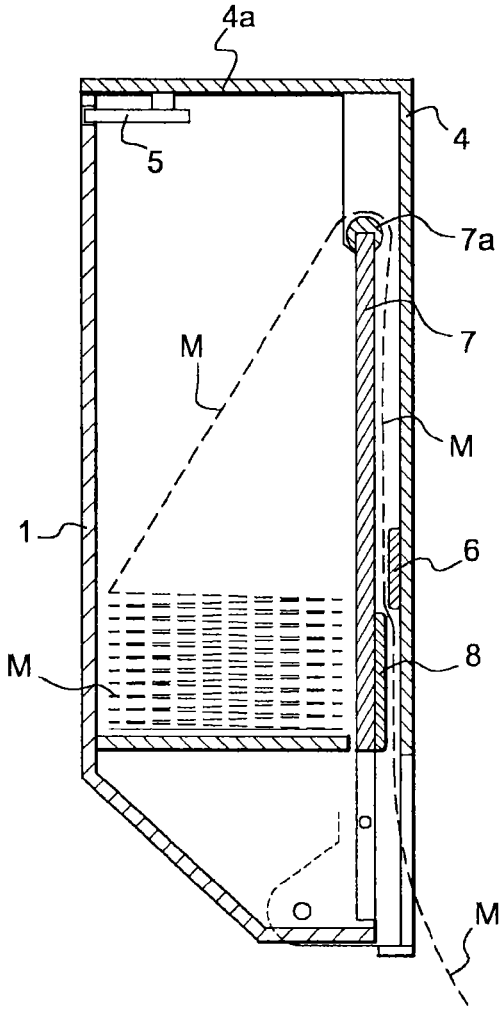
FIG. 3C is a cross-sectional view of the machine when it is closed, showing transport of the strip of material.
Figure 4:
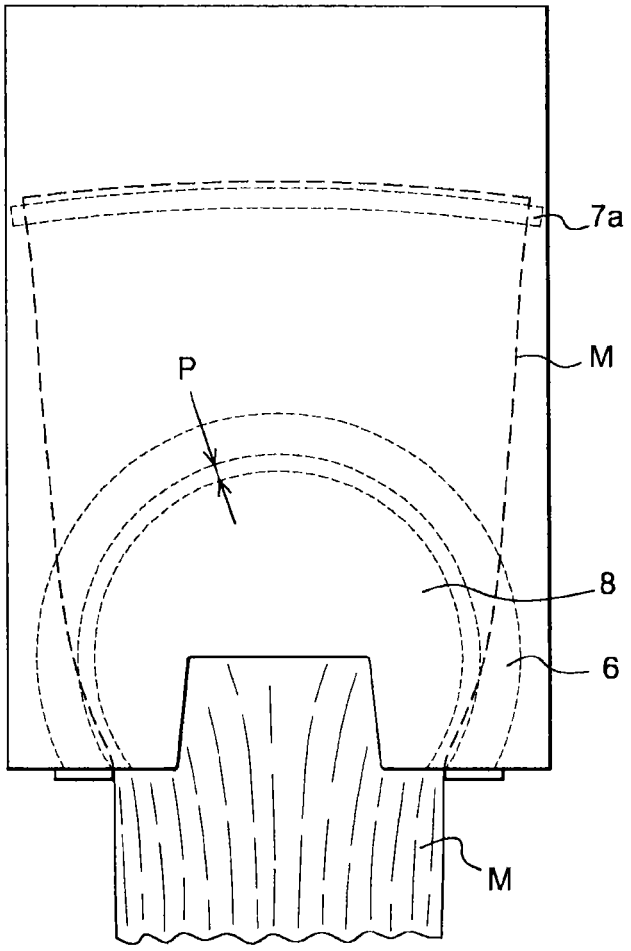
FIG. 4 is a front view of the machine showing how the strip of material pulled by the operative is formed as it emerges from the machine.
Figure 5:
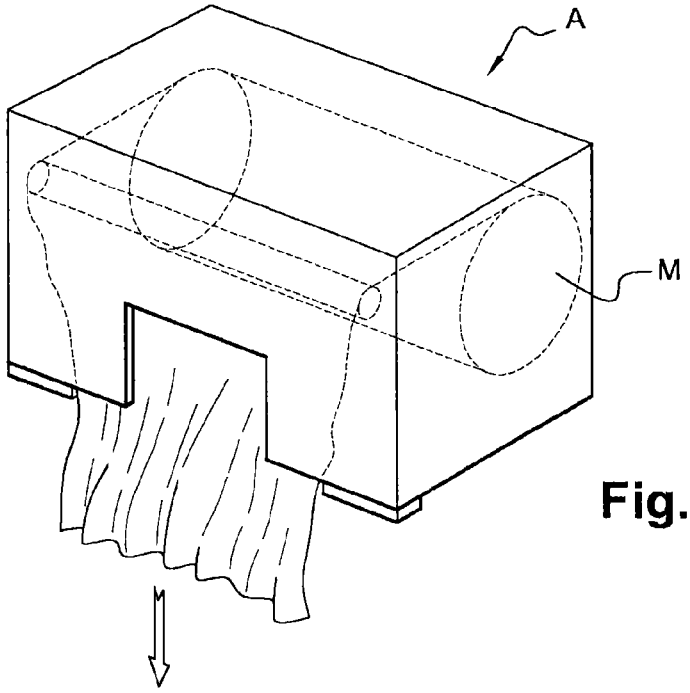
FIG. 5 is a three-quarter perspective view of a second model of the dispensing machine according to the invention.
Figure 6:
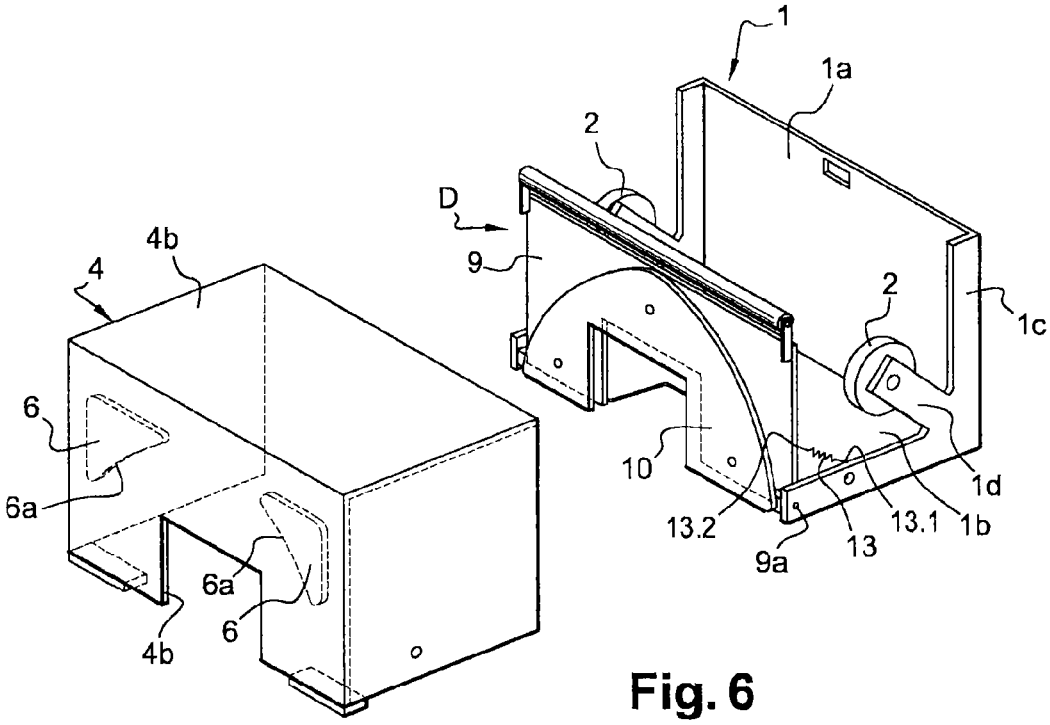
FIG. 6 is a three-quarter perspective view of the dispensing machine according to the invention, with its lid removed, and a feature for dispensing strips of pre-cut material.
Figure 7:
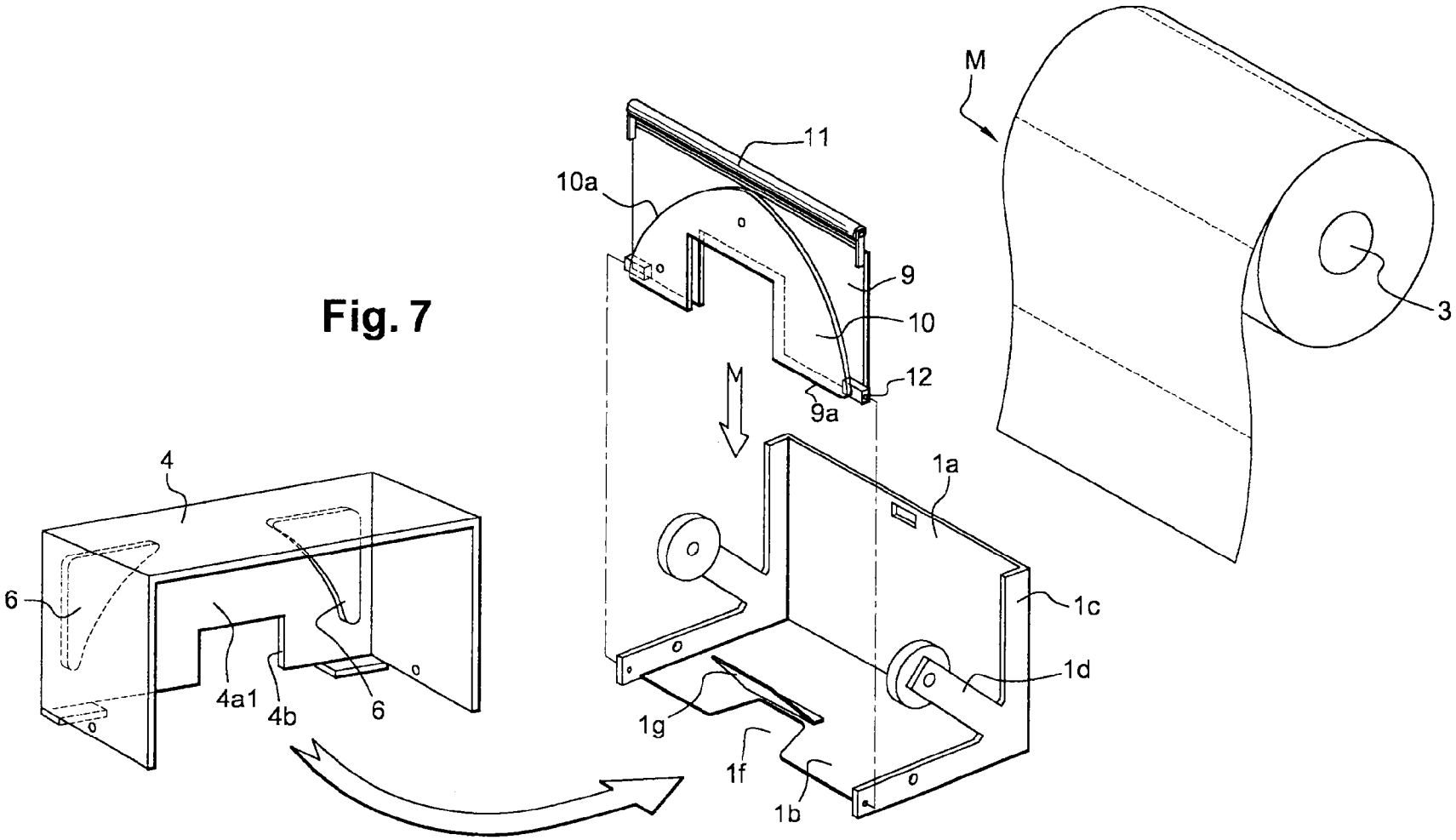
FIG. 7 is a view as in FIG. 6 but before assembly, showing the mechanisms and means used to guide the strip of material.
Figure 8:
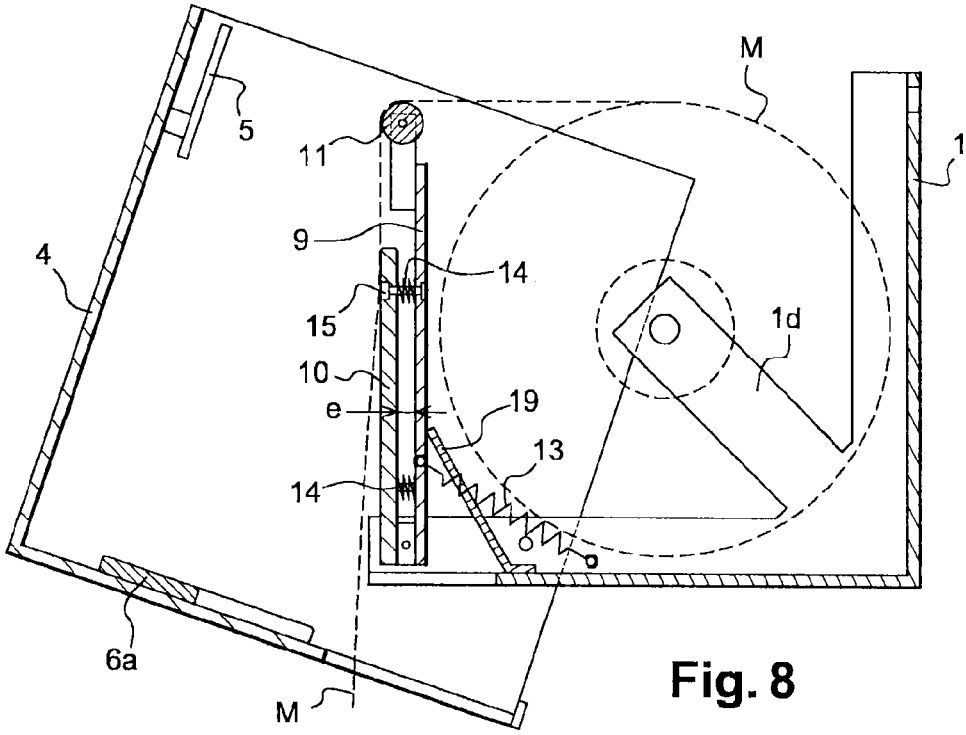
FIG. 8 is a cross-sectional side view of the dispensing machine when the cover is opened.
Figure 9:
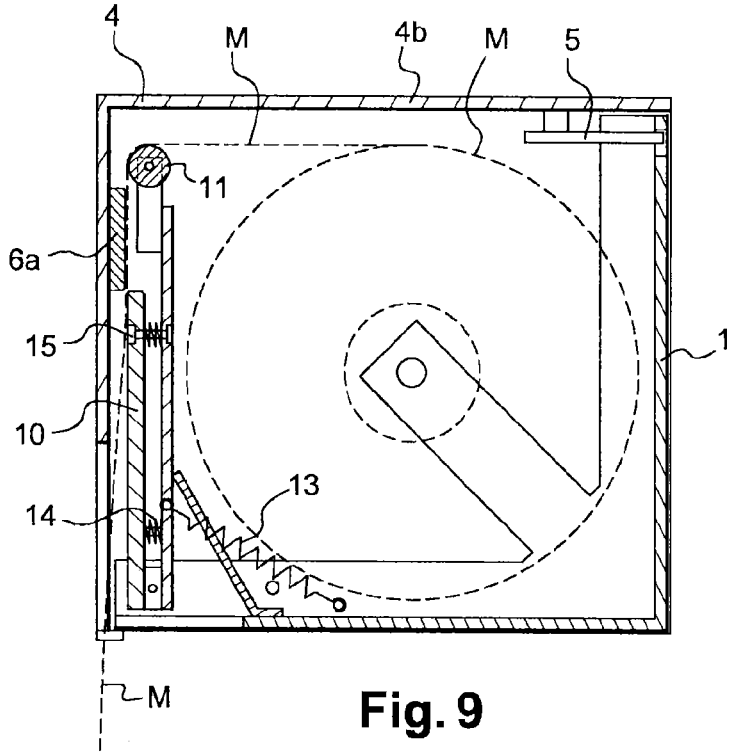
FIG. 9 is a side view as in FIG. 8 but with the cover closed.
Figure 10:
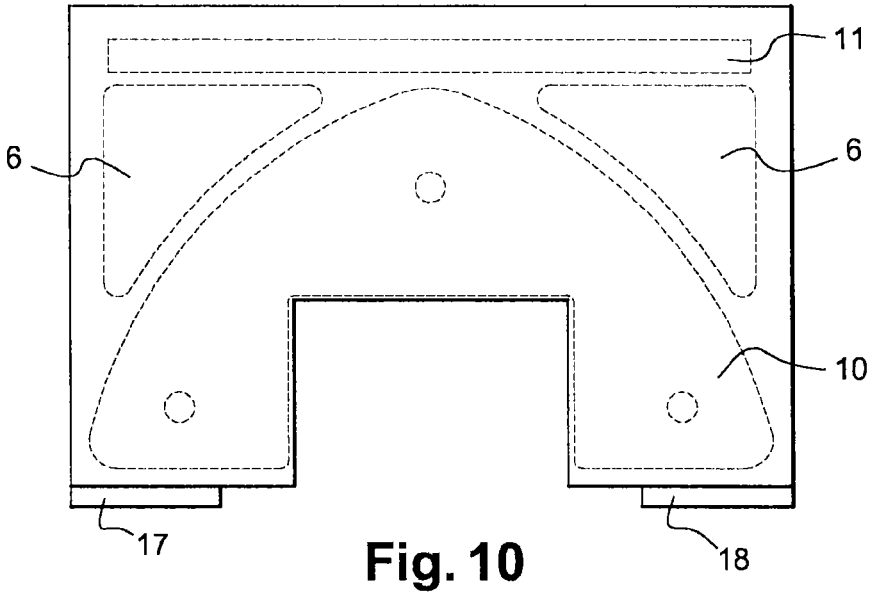
FIG. 10 is a front view showing the positioning of the various means used to prevent creasing of the pre-cut strip of material.
Figure 11:
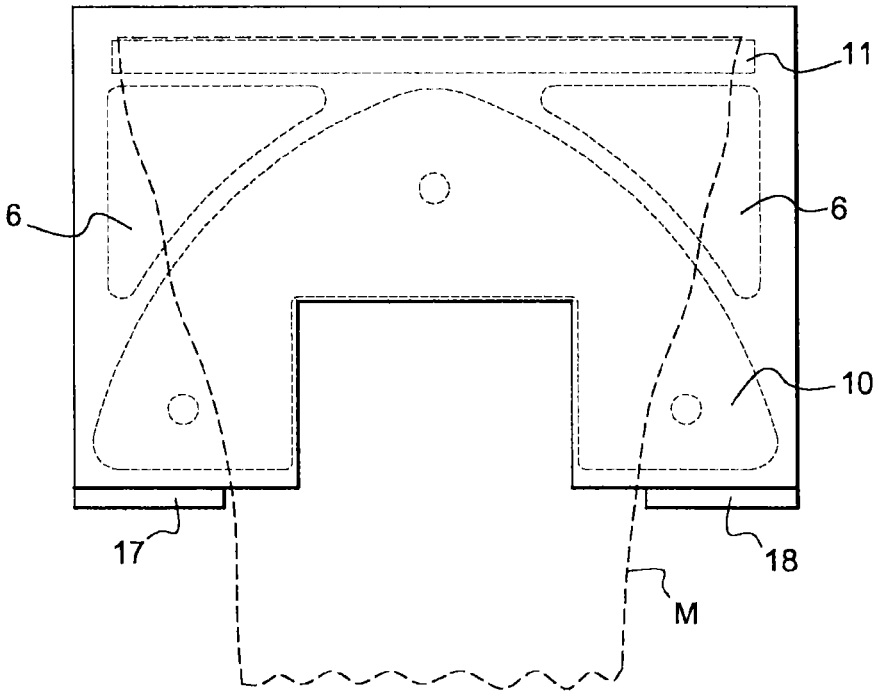
FIG. 11 is a view as in FIG. 10, showing how the pre-cut strip of material is unwound.

In the first case, said device (D) is made in the form of a single one-piece plate (7) which is capable of moving up against the front part of housing (1) and shutting it off by locking into position. To achieve this, the upper part of this single plate (7) which forms a flap is designed with a convex or rounded shape (7*a*) having a curved configuration which protrudes slightly either side of the thickness of the wall of the plate. This makes it possible to support and transport the pre-cut accordion-pleated material or material obtained from a pre-cut reel located in the rear part of the housing. Laterally, plate (7) has, on one or both of its edges (7*b*), a protruding shape which hooks onto the side wall or walls of the housing in order to obtain locking The version in FIG. 2B shows an internal hook shape (7*c*) which allows this locking and is produced when the housing is moulded. The base of flap (7) is hinged by shafts (5) which penetrate into openings in the side walls of the housing. At the front, as shown in FIG. 2A, flap (7) has a protruding shape (8) with a curved configuration which is capable of surrounding the matching shape (6) on the inner wall of the cover, thereby defining a space (P) through which the strip of material can pass. Shape (8) has a horseshoe appearance and fits around shape (6) perfectly, both of these components have the same thickness and virtually "sandwich" the strip of wipe material. The strip of material is therefore guided perfectly firstly by the upper convex part of flap (7) and secondly between shapes (8 and 6). As is apparent in FIG. 1, due to the opening formed in the cover, the pulled strip of material is flat and crease-free when it passes between shapes (6-8). In the lower part of the machine where the strip of material emerges, there are opposite-facing limit stops (17-18) either side of the strip of material which ensure separation of a piece of strip relative to the opposite facing perforation line of the strip. Also, the opening in order to pull the strip of material is upstream from where pieces of the strip of material are separated.

It is apparent that this first version of the machine comprises only three components, the housing, the cover and device (D) which constitutes a single plate (7) which fulfils the various functions of loading, guiding and preventing creasing of the strip of material. These three components are made of plastic and can be assembled by simply snapping them together without any external screws or similar fasteners. When the machine is closed, the front wall of the cover is parallel to plate (7) leaving room for the strip of material and enabling it to be pulled and emerge from the lower front part of the machine. If the material is in a folded pre-cut configuration, the configuration of the folded material makes it possible to route the material over the device on the upper part of the housing (7*a*) and then dispense it one piece at a time.

In the case of a reel of pre-cut material, the retention and transport of the strip of material between matching shapes (6-8) allow, in combination with lateral limit stops (17-18), successive separation of pieces of material. These limit stops which are in contact with the material exert a retention effect which involves separation of the piece of strip by gradual tearing from the ends of the perforation line and thus complete separation of a piece of a strip from the rest of the strip of material.

The second version of the invention illustrated in FIGS. 5 to 12 is described below. In this embodiment, device (D) includes two means: a plate for loading and guiding (9) and an anti-crease plate (10).

Cover (4) is designed with two identical matching protruding extra-thick shapes (6) either side of cut-out (4*b*) which have a triangular configuration, for example, and the base of each shape has a curved configuration (6*a*). The solid exposed faces of these two shapes (6*a*) are capable of constituting support surfaces over which the pulled strip of material slides flat and are involved in shaping the strip as it emerges from the machine. These shapes (6*a*) are roughly 2 to 3 mm thick.

Device (D) comprises a loading plate (9) which is articulated relative to the housing and has, on its upper end, a deflecting roller (11) and a plate (10) for preventing creasing of the pre-cut strip of material from a reel or the accordion-pleated material, located in front of the loading plate in a parallel plane and elastically recoiling relative to the plate.

More specifically, the base (9*a*) of loading plate (9) is articulated around pivot axes (12) relative to the side walls (1*c*) of the housing and is in the longitudinal plane of the housing. This plate (9) is articulated in opposition to elastic return means (13) of the spring type with a forward pivoting movement in order to assist the pull force exerted when the strip of pre-cut material is pulled by the user. One end (13-1) of the return means is attached to one of the side walls of the housing or, if applicable, to the back plate. The other end (13-2) of the return means is attached to the loading plate. In addition, loading plate (9) has a central cut-out (9*b*) which directly matches the above-mentioned cut-outs (1*f*) and (4*b*) in the housing and in the cover. The upper part of loading plate (9) has flexible tabs (9*c*) between which deflecting roller (11) is fitted. The latter is therefore in the upper part and in contact with the strip of material obtained from a reel or accordion-pleated material as it is paid out. Advantageously, to obtain better guidance, deflecting roller (11) has a curved configuration and its ends are thus bowed in order to allow the strip of material to be pulled by the user to the right or to the left. Plate (10) for preventing creasing of the strip of material is located in front of loading plate (9) in a plane which is parallel to the latter and leaves a gap (e) between them. This anti-crease plate is elastically attached relative to the loading plate in opposition to return means (14) mounted on connecting shafts (15) or equivalent which are attached on the loading plate. Thus, the anti-crease plate, which constitutes the flat bearing surface for the pre-cut strip of material after it passes over the roller and is deflected, is capable of elastically controlled movement relative to the loading plate, depending on the pulling and tensile forces exerted on the pulled strip of material. Also and according to one aspect of invention, said anti-crease plate (10) has an upper half-moon or curved shape (10*a*) to allow transport of the pre-cut strip of material and to direct it towards the outlet of the machine. This half-moon shape matches the curved shapes on the protruding parts on the inner face of the cover by fitting between them and leaving room (P) for the strip of material to pass through. It is therefore apparent that, when the machine is closed, the anti-crease plate comes up against the inner face of the cover and defines a route and guides output of the strip of material.

The thickness of the anti-crease plate is identical to that of the protruding parts so as to ensure that they fit inside each other snugly. When the cover is closed, there is a space (P) of 3 to 5 mm, for instance, between the respective curved edges of the protruding parts and the half-moon shape of the anti-crease plate in order to allow the strip of material to slide through. Return means (14) make it possible, through elastic expansion of the spring, to push the anti-crease plate against the inner face of the cover by exerting slight pressure.

The anti-crease plate, by flattening the strip of material, allows it to slide as it emerges from the machine.

The pull force exerted ensures separation of a piece of strip from the rest of the reel as its movement comes to an end thanks to two limit stops (17-18). The various cut-outs in the cover, loading plate and anti-crease plate enable the user to grasp the material.

Figure 12:
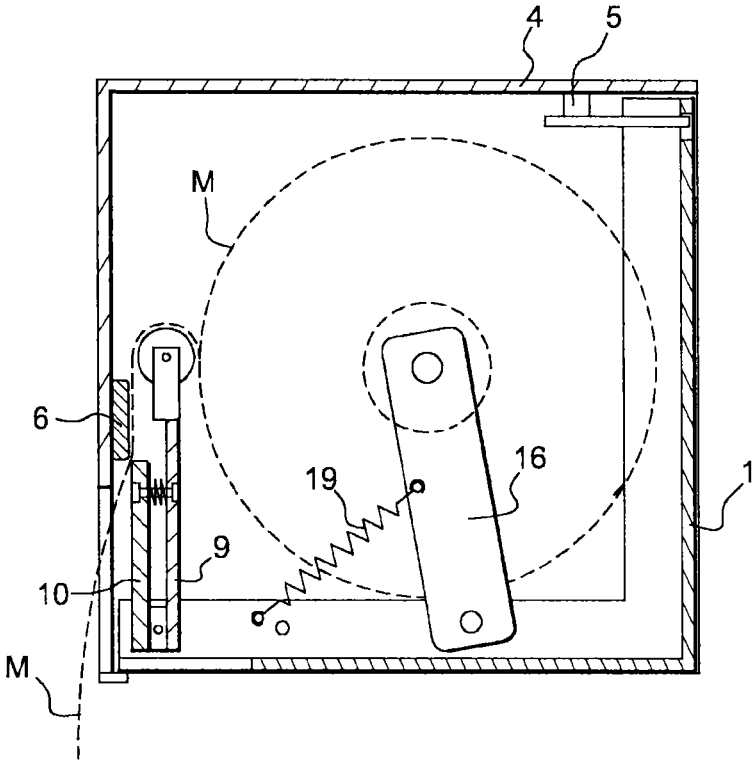
FIG. 12 is a side view of a version of the dispensing machine in which the reel of material is positioned differently and oppositely to FIG. 6.

Without departing from the scope of the invention, FIG. 12 shows an alternative implementation in which the position of the reel of pre-cut material is reversed compared with the position illustrated earlier. The reel of material is mounted on arms (16) that are elastically articulated by return means (19) so that the reel always rests on the deflecting roller. The reel's support arms swivel in the direction of arrow (F1) and the strip is paid out in the direction of arrow (F2).

Moreover and according to one essential aspect of the invention, it is possible to envisage dimensional adjustment of the dispensed strip of material. To achieve this, the two limit stops (17-18) are arranged symmetrically relative to the area through which the strip of material passes and emerges. These limit stops are located close to the front lower part of the machine and slide relative to its edge. These limit stops are therefore adjusted on the machine depending on the configuration of the various versions.

The solution provided by the invention is extremely practical, inexpensive and very easy to use.

It is applicable to various methods of presenting the strip of pre-cut material, i.e. on a reel or accordion pleaded.

The machine can be made of plastic or of disposable cardboard packaging.

The invention claimed is:

1. A dispensing machine for wipe materials comprising a housing forming a receptacle with a back plate, a lower horizontal wall, side walls, and an articulated cover with means of locking, wherein an inner face of the cover has a protruding member having a curved shape, and further comprising a device which is articulated relative to the housing and fulfils the functions of loading, guiding and preventing creasing of pulled pre-cut strip of material so that the strip can be removed from a lower front part of the machine, and said device includes a curved raised element surrounding the protruding member on the cover when said cover is closed, said element and member being concentric and leaving room for the pulled pre-cut strip of material to pass through, and further including, in the lower part of the machine where the strip of material emerges, opposite-facing limit stops mounted on either side of the strip of material which ensure separation of a piece of strip relative to an opposite facing perforation line of the strip.

2. The machine as claimed in claim 1, wherein the device for loading, guiding and preventing creasing of the pre-cut strip of material comprises a single component which fulfils said functions.

3. The machine as claimed in claim 2, wherein the device comprises a single plate which is articulated relative to the housing and locks into position, said plate having a convex shape with a curved configuration that protrudes relative to a thickness of the plate and said plate has the curved raised element surrounding, after the cover has been closed onto the housing, the curved protruding member on the inner wall of the cover, thereby leaving room for the strip of material to pass through.

4. The machine as claimed in claim 3, wherein the curved raised element has a horseshoe configuration.

5. The machine as claimed in claim 3, wherein the plate has, on at least one of its edges, a protrusion which attaches to an inner part of the housing comprising a means of locking.

6. The machine as claimed in claim 1, wherein the device for loading, guiding and preventing creasing of the pre-cut strip of material comprises a loading plate for loading and guiding the strip of material and an anti-crease plate for preventing creasing.

7. The machine as claimed in claim 6, wherein the anti-crease plate is located in front of the loading plate in a parallel plane and is moveable relative to the loading plate, and the anti-crease plate and the inner face of the cover are provided, respectively, with the raised element and the protruding member fitting into each other in a curved configuration and allowing the pulled strip of material to be transported and guided, and an upper part of loading plate comprises a roller that deflects the strip of material so that the strip can be inserted between the anti-crease plate and the cover before being dispensed.

8. The dispensing machine as claimed in claim 7, wherein the lower horizontal wall has a central cut-out in its front part and, offset to the rear of the said central cut-out, there is provided a transverse wall which delimits positioning of a reel of wipe material, and the cover has a front wall with an opening located opposite the central cut-out which leaves room for a user's fingers in order to grasp the material.

9. The dispensing machine as claimed in claim 8, wherein the protruding member comprises, one on each side of the front wall opening, two identical protruding shapes having a geometrical configuration and defining a curved configuration at a base of each shape, and solid exposed faces of the two shapes constitute support surfaces over which the pulled strip of material slides as the strip emerges from the machine.

10. The dispensing machine as claimed in claim 9, wherein the anti-crease plate has an upper half-moon or curved shape to allow the strip of material through and to direct the strip towards an outlet of the machine, and the half-moon or curved shape matches the curved shapes of the protruding member on the inner face of the cover by fitting between the curved shapes and leaving room for the strip of material to pass through, and the anti-crease plate comes up against the inner face of the cover and defines a route and guides output of the strip of material.

11. The dispensing machine as claimed in claim 8, wherein the opening to pull the strip of material is upstream from where pieces of strip of material are separated.

12. The dispensing machine as claimed in claim 7, wherein the base of the loading plate is articulated around pivot axes relative to the side walls of the housing and is in a longitudinal plane of the housing, and the loading plate is articulated in opposition to elastic return means with a forward pivoting movement in order to assist pull force exerted when the strip of material is pulled by the user, and one end of the return means is attached to one of the side walls of the housing, and an other end of the return means is attached to the loading plate, and the loading plate has a central cut-out which matches the cut-outs and in the housing and in the cover.

13. The dispensing machine as claimed in claim 7, wherein an upper part of loading plate has flexible tabs between which a deflecting roller is fitted, and the deflecting roller is therefore in the upper part and in contact with the strip of material.

14. The dispensing machine as claimed in claim 13, wherein the deflecting roller has a curved configuration and bowed ends allowing the strip of material to be pulled by the user to the right or to the left.

15. The dispensing machine as claimed in claim 7, wherein the anti-crease plate is located in front of the loading plate in a plane which is parallel to the loading plate and leaves a gap between the anti-crease plate and the loading plate, and the anti-crease plate is moveable relative to the loading plate in opposition to return means mounted on connecting shafts attached on the loading plate.

16. The dispensing machine as claimed in claim 15, wherein the return means comprises a spring that permits, through elastic expansion of the spring, to push the anti-crease plate against the inner face of the cover by exerting slight pressure.

17. The dispensing machine as claimed in claim 1, wherein the strip of material comprises a reel, a core of the reel being located between flexible tabs formed on the side walls of the housing.

18. The dispensing machine as claimed in claim 1, wherein the strip of material comprises a reel of material mounted on arms that are elastically articulated by return means so that the arms always rest on a deflecting roller and support arms of the reel swivel.

19. The dispensing machine as claimed in claim 1, wherein, in order to allow dimensional adjustment of output of the strip of material, two positionally adjustable limit stops are symmetrically arranged relative to an area through which the strip of material passes and emerges.

20. The dispensing machine as claimed in claim 1, wherein the machine is made of disposable cardboard packaging.

* * * * *